US005336423A

United States Patent [19]

Pialet et al.

[11] Patent Number: 5,336,423

[45] Date of Patent: Aug. 9, 1994

[54] POLYMERIC SALTS AS DISPERSED PARTICLES IN ELECTRORHEOLOGICAL FLUIDS

[75] Inventors: Joseph W. Pialet, Euclid; Kasturi Lal, Willoughby; Charles P. Bryant, Euclid, all of Ohio

[73] Assignee: the Lubrizol Corporation, Wickliffe, Ohio

[21] Appl. No.: 878,797

[22] Filed: May 5, 1992

[51] Int. Cl.[5] ..... C10M 169/00; C10M 171/00

[52] U.S. Cl. ..... 252/76; 252/73; 252/79; 252/572

[58] Field of Search ..... 252/73, 76, 79, 572; 526/318.25, 240; 524/559

[56] References Cited

U.S. PATENT DOCUMENTS

| | | | |
|---|---|---|---|
| 2,417,850 | 3/1947 | Winslow | 175/320 |
| 3,030,342 | 4/1962 | Tiefenthal et al. | 526/240 |
| 4,025,484 | 5/1977 | Evani et al. | 526/318.25 |
| 4,033,892 | 7/1977 | Stangroom | 252/76 |
| 4,129,513 | 12/1978 | Stangroom | 252/78.1 |
| 4,153,592 | 5/1979 | Burroway et al. | 526/318.25 |
| 4,246,154 | 1/1981 | Yao | 526/240 |
| 4,267,103 | 5/1981 | Cohen | 526/240 |
| 4,483,788 | 11/1984 | Stangroom et al. | 252/578 |
| 4,645,614 | 2/1987 | Goossens et al. | 252/75 |
| 4,668,417 | 5/1987 | Goossens et al. | 252/75 |
| 4,687,589 | 8/1987 | Block et al. | 252/73 |
| 4,812,251 | 3/1989 | Stangroom | 252/75 |
| 4,879,056 | 11/1989 | Filisko et al. | 252/74 |
| 4,992,192 | 2/1991 | Ahmed | 252/73 |

FOREIGN PATENT DOCUMENTS

| | | |
|---|---|---|
| 0170939 | 2/1986 | European Pat. Off. . |
| 0393692 | 10/1990 | European Pat. Off. . |
| 0393693 | 10/1990 | European Pat. Off. . |
| 1-081898 | 3/1989 | Japan . |
| 1-139639 | 6/1989 | Japan . |
| 1-266193 | 10/1989 | Japan . |

*Primary Examiner*—Christine Skane
*Attorney, Agent, or Firm*—David M. Shold

[57] ABSTRACT

Electrorheological fluids which exhibit good high temperature performance are made using as the disperse phase a salt of a polymer of an alkenyl substituted aromatic comonomer such as styrene and a maleic acid comonomer or derivative thereof,

12 Claims, No Drawings

POLYMERIC SALTS AS DISPERSED PARTICLES IN ELECTRORHEOLOGICAL FLUIDS

BACKGROUND OF THE INVENTION

The present invention relates to electrorheological fluids which contain as the dispersed particles salts of polymers, and electrorheological devices made using such fluids.

Electrorheological ("ER") fluids are fluids which can rapidly and reversibly vary their apparent viscosity in the presence of an applied electric field. ER fluids are generally dispersions of finely divided solids in hydrophobic, electrically non-conducting oils. They have the ability to change their flow characteristics, even to the point of becoming solid, when subjected to a sufficiently strong electrical field. When the field is removed, the fluids revert to their normal liquid state. ER fluids may be used in applications in which it is desired to control the transmission of forces by low electric power levels, for example, in clutches, hydraulic valves, shock absorbers, vibrators, or systems used for positioning and holding work pieces in position.

ER fluids have been known since 1947, when U.S. Pat. No. 2,417,508 was issued to Winslow, disclosing that certain dispersions of finely divided solids such as starch, carbon, limestone, gypsum, flour, etc., dispersed in a non-conducting liquid would undergo an increase in flow resistance when an electrical potential difference was applied. In the extensive work which has followed this discovery, many variations of ER fluids have been discovered, in which the solid phase, the liquid phase, or other components have been varied. One feature of most ER fluids is that at least a small amount of a polar substance, generally water, must be absorbed or adsorbed by the dispersed particles in order to provide significant ER properties. Unfortunately, water-containing systems generally exhibit limited useful operating temperature ranges. At temperatures above about 100° C. the performance of such systems typically deteriorates due to volatilization of the water.

Among the various attempts to provide an improved ER fluid are the following:

U.S. Pat. No. 4,033,892 discloses electrorheological fluids wherein the solid substance is a polyhydric alcohol which contains acid groups and which has an open structure wherein a significant amount of water is absorbed. In a preferred embodiment the polyhydric alcohol is a polymer of a monosaccharide which is insoluble in water. Other suitable materials include polyvinyl alcohol and polymers of a monosaccharide derived from starch. The polyhydric alcohol may be a salt rather than a free acid. ER fluids which contain a relatively low amount of absorbed water may be particularly useful for high temperature applications.

U.S. Pat. No. 4,473,778 discloses an electroviscous fluid comprising water-containing particles of a phenol-formaldehyde polymer dispersed in a non-conducting liquid. In a preferred embodiment the polymer comprises the dilithium salt of 2,2',4,4'-tetrahydroxybenzophenone condensed with formaldehyde.

U.S. Pat. No. 4,812,251 discloses an electrorheological fluid comprising a hydrophilic solid and a hydrophobic liquid component. This reference reports that ionic polymers, such as algenic acid, polymethacrylic acid, and phenol-formaldehyde resins have been used, usually as salts. The solid component can comprise an organic polymer containing free or salified acid groups.

U.S. Pat. No. 4,992,192 discloses electrorheological fluids prepared from monomers (such as styrene or methacrylic acid) polymerized by dispersion polymerization in a medium which also serves as the dispersion medium for the fluid. The particles are modified by polymerizing a hydrophilic shell around the particle followed by neutralization through addition of an organic soluble base. Suitable monomers for the hydrophilic shell include maleic acid, vinyl toluene sulfonate, and others. The hydrophilic shell polymer is neutralized by reaction with e.g. butyl lithium.

The present invention now provides an ER fluid which is based on a polymeric salt which retains its useful function at elevated temperatures.

SUMMARY OF THE INVENTION

The present invention provides an electrorheological fluid comprising a hydrophobic liquid phase and particles of a polymer dispersed therein, said polymer comprising an alkenyl substituted aromatic comonomer, a maleic acid comonomer or derivative thereof, and 0 to about 20 mole percent of at least one third comonomer, wherein the polymer contains acid functionality which is at least partly in the form of a salt. The invention further provides a clutch, valve, shock absorber, or damper containing such an electrorheological fluid.

DETAILED DESCRIPTION OF THE INVENTION

The ER fluid of the present invention comprises a hydrophobic liquid phase, a dispersed particle phase, and other optional ingredients.

The Hydrophobic Liquid Phase

The ER fluids of the present invention comprise a hydrophobic liquid phase which is a non-conducting, electrically insulating liquid or liquid mixture. Examples of insulating liquids include silicone oils, transformer oils, mineral oils, vegetable oils, aromatic oils, paraffin hydrocarbons, naphthalene hydrocarbons, olefin hydrocarbons, chlorinated paraffins, synthetic esters, hydrogenated olefin oligomers, and mixtures thereof. The choice of the hydrophobic liquid phase will depend largely on practical considerations including compatibility of the liquid with other components of the system, solubility of certain components therein, and the intended utility of the ER fluid. For example, if the ER fluid is to be in contact with elastomeric materials, the hydrophobic liquid phase should not contain oils or solvents which affect those materials. Similarly, the liquid phase should be selected to have suitable stability over the intended temperature range, which in the case of the present invention will extend to 120° C. or even higher. Furthermore, the fluid should have a suitably low viscosity in the absence of a field that sufficiently large amounts of the dispersed phase can be incorporated into the fluid.

Silicon-based oils such as the polyalkyl-, polyaryl-, polyalkoxy-, or polyaryloxysiloxane oils and silicate oils comprise a particularly useful class of synthetic hydrophobic liquids. Examples of silicate oils include tetraethyl silicate, tetraisopropyl silicate, tetra-(2-ethylhexyl) silicate, tetra-(4-methyl-2-ethylhexyl) silicate, and tetra-(p-terbutylphenyl) silicate. The silicone or siloxane oils are useful particularly in ER fluids which are to be in contact with elastomers. The selection of other silicone-containing fluids will be apparent to those skilled in the art.

Among the suitable vegetable oils for use as the hydrophobic liquid phase are sunflower oils, including high oleic sunflower oil available under the name Trisun TM 80, rapeseed oil, and soybean oil. By way of example, one of the suitable esters is di-isodecyl azelate, available under the name Emery TM 2960. Another illustrative fluid is hydrogenated poly alpha olefin, available under the name Emery TM 3004. Examples of other suitable materials for the hydrophobic liquid phase are set forth in detail in U.S. patent application Ser. No. 07/823,489, filed Jan. 21, 1992 (case 2598R/B).

The Dispersed Particle Phase

The dispersed particles of the ER fluid of the present invention comprise a polymeric material comprising an alkenyl substituted aromatic comonomer, a maleic acid comonomer or derivative thereof, and optionally at least one additional comonomer. The polymer contains acid functionality which is at least partly in the form of a salt.

Maleic acid is cis-butenedioic acid. It can be incorporated into a polymer by direct copolymerization or by grafting and is often reacted as its cyclic anhydride. Upon polymerization the ethylenic double bond of the acid is reduced to a single bond, so that the resulting monomer could also be described as a succinic acid derivative. Fumaric acid is the trans isomer of butenedioic acid. Upon incorporation into a polymer chain this material is indistinguishable from a comonomer derived from maleic acid; hence fumaric acid is included in the present invention. Derivatives of maleic acid are also included in the present invention. Such derivatives may involve substitution on one of the carbon atoms by an alkyl group or by another substituent such as hydroxy, alkoxy, aryloxy, halogen, and so on; common derivatives of this type include citraconic acid and itaconic acid. Itaconic acid is methylene succinic acid; that is, the ethylenic unsaturation is one carbon atom removed from its normal position in maleic acid. Itaconic acid and its derivatives are nevertheless included within the scope of the present invention. A preferred acid is maleic acid.

Similarly, derivatives of maleic acid include reaction products of one or both of the acid groups. For example, maleic anhydride can be reacted with a number of materials such as alcohols or amines to provide esters, amides, or imides. If an excess of maleic anhydride is reacted with an alcohol the result can be a partial ester (e.g. a half ester) in which some of the acid functionality is bound in the form of an ester and some of the acid functionality remains free.

It is normally the maleic acid comonomer or derivative thereof which provides the acid functionality of the copolymer, although other comonomers, discussed below, can also contribute acid functionality. Accordingly, at least a part of the acid functionality of the maleic acid comonomer is normally in the form of a salt. The type of salt is not particularly limiting and can include, for example, amine or ammonium salts as well as other organic salts and metal salts. Preferably the maleic acid or derivative is at least partially neutralized with a monovalent, divalent, or trivalent cation, more preferably a metal cation selected from the group consisting of sodium, potassium, lithium, calcium, and aluminum. Most preferably the neutralizing metal is sodium or lithium.

Neutralization of the acid functionality can be effected by any commonly used route, including treatment of the acid-containing polymer with a base in the melt or in organic or aqueous medium. Most often the neutralization of the acid functionality will be effected after the comonomers are polymerized. Thus although expressions such as "a salt of maleic acid comonomer" are commonly used herein for convenience, such language is not intended to suggest that the monomer is necessarily converted to the salt prior to polymerization. Normally it is the acid or anhydride which is copolymerized, and neutralization or other chemistry is effected thereafter. Rather what is meant is simply that the acid functionality of the pertinent part of the polymer has been neutralized. Neither is there any intention by such expressions to limit the structure of the salts or complexes referred to. To refer to "a partially neutralized maleic acid comonomer," for example, is not intended to be limited to the physical association of the neutralizing ion with one part or another of the polymer. Rather, as normally practiced the neutralizing base is added to the polymer in an amount which is calculated to be stoichiometrically sufficient to convert at least a portion of the free acid groups of the polymer to the corresponding salt. Although it is believed that acid-base neutralization normally occurs, the actual chemical fate of the acid and base moieties is not of greatest concern. Therefore we can say that the polymer containing the maleic anhydride comonomer or derivative thereof is treated preferably with at least about 0.5 equivalents of base, and more preferably with at least about 0.75 equivalents of base, per equivalent of acid functionality in the polymer. The normal upper limit on the amount of base is 1.0 equivalent of base per equivalent of acid functionality, although an excess of base, i.e., up to about 2 equivalents of base can be used, resulting in a product which contains excess basic metal ions.

A second monomer of the polymer which forms the disperse phase is an alkenyl-substituted aromatic comonomer. This comonomer is normally copolymerized into or grafted onto the polymer chain through the ethylenic unsaturation in the alkenyl substituent group. The aromatic comonomer may have a single aromatic ring (benzene ring) or it may have fused or multiple aromatic rings. Examples of fused or multiple aromatic ring materials include alkenyl substituted naphthalenes, acenaphthenes, anthracenes, phenanthrenes, pyrenes, tetracenes, benzanthracenes, biphenyls, and the like. The aromatic comonomer may also contain one or more heteroatoms in the aromatic ring, provided that the comonomer substantially retains its aromatic properties. Such heteroaromatic materials include alkenyl-substituted pyridine, diazines, pyrroles, imidazoles, and thiophene.

The nature of the alkenyl group is not particularly limited, provided that the alkenyl group provides an adequate means for incorporation of the alkenyl aromatic comonomer into the polymer chain. The alkenyl group is commonly a vinyl ($CH_2{=}CH{-}$) group; The most preferred alkenyl aromatic comonomer is styrene (vinyl benzene).

The alkenyl aromatic comonomer may be substituted either on the aromatic ring or on the alkenyl side chain. The nature of the substitution is not particularly limited; substitution can be by an alkyl group or by another substituent such as hydroxy, alkoxy, aryloxy, halogen, and so on. The aromatic ring can also be substituted with acid functionality such as one or more carboxylic acid, phosphonic acid, or preferably sulfonic acid groups, or derivatives thereof. Such acid functionality will contribute to the total acid functionality of the copolymer and can be at least partly neutralized along with the acid functionality of the maleic acid or maleic acid derivative comonomers. Such functionality can be added either before or after the polymer is formed.

While normally the polymeric material of the present invention will be a binary copolymer of maleic anhydride or a derivative thereof with an alkenyl-substituted aromatic comonomer, it is possible that one or more additional comonomers may be present. One class of such comonomers comprises those comonomers which impart branching or crosslinking to the polymer chain. Such branching or crosslinking may sometimes be desired in order to improve certain of the physical properties of the polymer, for instance, to increase the melting point. Examples of comonomers suitable for this purpose include bis-acrylamide, triethylene glycol diacrylate or dimethacrylate, ethylene glycol diacrylate or dimethacrylate, polyethylene glycol diacrylate or dimethacrylate, butylene glycol diacrylate or dimethacrylate, butanediol diacrylate or dimethacrylate, diethylene glycol diacrylate or dimethacrylate, hexanediol diacrylate or dimethacrylate, neopentyl glycol diacrylate or dimethacrylate, tetraethylene glycol diacrylate or dimethacrylate, tripropylene glycol diacrylate or dimethacrylate, ethoxylated bisphenol A diacrylate or dimethacrylate, acrylate or methacrylate terminated monomers with average chain length of $C_{14}$ to $C_{15}$, tris(2-hydroxy ethyl) isocyanurate triacrylate or trimethacrylate, pentaerythritol tetraacrylate or tetramethacrylate, trimethylolpropane triacrylate or trimethacrylate, dipentaerythritol pentaacrylate or pentamethacrylate. Also included is the use of divalent or trivalent metal ions or polyamines to effect crosslinking. Of particular interest are those comonomers which may themselves be alkenyl substituted aromatic materials, in particular, dialkenyl substituted aromatic materials. Such aromatic comonomers may be introduced into the copolymer at suitable levels to effect the desired branching or crosslinking yet without introducing the presence of a substantially different type of monomer to the system. The most preferred dialkenyl substituted aromatic comonomer is divinylbenzene.

Still other comonomers may be introduced into the copolymer for various purposes, e.g. to modify the solubility, processing, chemical, or theological properties of the polymer. Such other comonomers are not limited in type provided they do not adversely affect the basic novel and functional properties of the invention. In particular such comonomers may be selected from the group consisting of ethylenically unsaturated carboxylic acids having 3 to about 22 carbon atoms, salts, esters, amides, and nitriles of such acids, ethylenically unsaturated vinyl ethers having 3 to about 22 carbon atoms, vinyl esters of carboxylic acids where the acid group has 1 to about 22 carbon atoms, and alpha olefins of 2 to about 20 carbon atoms. Preferred examples of such comonomers include acrylic acid, methacrylic acid, ethacrylic acid, methyl acrylate or methacrylate, ethyl acrylate or methacrylate, propyl acrylate or methacrylate, butyl acrylate or methacrylate, octyl acrylate or methacrylate, allyl acrylate or methacrylate, tetrahydrofuryl acrylate or methacrylate, cyclohexyl acrylate or methacrylate, hexyl acrylate or methacrylate, ethoxyethyl acrylate or methacrylate, decyl acrylate or methacrylate, stearyl acrylate or methacrylate, lauryl acrylate or methacrylate, phenoxyethyl acrylate or methacrylate, glycidyl acrylate or methacrylate, isobornyl acrylate or methacrylate, benzyl acrylate or methacrylate, vinyl acetate, vinyl propionate, vinyl butyrate, acrylonitrile, methacrylonitrile, and 2-acrylamido-2-methylpropane sulfonic acid and salts and derivatives thereof. The most preferred third comonomers are methyl methacrylate, 2-acrylamido-2-methylpropanesulfonic acid, and salts thereof.

The amount of the third comonomer (which term includes 4th and higher comonomers) is normally 0 to about 20 mole percent of the copolymer. Preferably the amount of the third comonomer is 0 to about 5 mole percent, and most preferably the amount of the third comonomer is about 0%.

The molar ratio of the alkenyl substituted aromatic monomer to the maleic acid monomer or derivative thereof in the copolymer is normally about 5:1 to about 1:1.5. Preferably the copolymer contains these two comonomers in a ratio of about 1:1, particularly preferably in the substantial absence of third comonomer. This 1:1 mole ratio is preferred in part because maleic anhydride and styrene comonomers under certain reaction conditions copolymerize in about this ratio in a regularly alternating fashion. This regularly alternating 1:1 copolymer of maleic anhydride and styrene is a preferred copolymer for the present invention.

The regularly alternating 1:1 copolymer of maleic anhydride and styrene can be prepared by polymerizing equimolar amounts of maleic anhydride and styrene with stirring in a toluene medium under nitrogen. A free radical initiator is used; if benzoyl peroxide is selected, the polymerization reaction is run at 100° C. over a course of several hours.

The polymer of the present invention is present in the ER fluid as dispersed particles. These particles normally have a number average size of about 0.25 to about 100 μm, preferably about 1 to about 20 μm. The maximum size of the particles would depend in part on the dimensions of the electrorheological device in which they are intended to be used. The amount of such polymer particles in the ER fluid should be sufficient to provide a useful electrorheological effect at reasonable applied electric fields. However, the amount of particles should not be so high as to make the fluid too viscous for handling in the absence of an applied field. These limits will vary with the application at hand: an electrorheologically active grease, for instance, would desirably have a higher viscosity in the absence of an electric field than would a fluid designed for use in e.g. a valve or clutch. Furthermore, the amount of particles in the fluid may be limited by the degree of electrical conductivity which can be tolerated by a particular device, since the polymeric particles normally impart at least a slight degree of conductivity to the total composition. For most practical applications the polymeric particles will comprise about 5 to about 60 percent by weight of the ER fluid, preferably about 15 to about 55 percent by weight, and most preferably about 30 to about 45 percent by weight. Of course if the nonconductive hydrophobic fluid is a particularly dense material such as carbon tetrachloride or certain chlorofluorocarbons, these weight percentages could be adjusted to take into account the density; practical considerations might dictate that a volume percent concentration calculation would be more appropriate. Determination of such an adjustment would be within the abilities of one skilled in the art.

Additional Components

The polymer of the present invention normally will be inherently associated with at least a trace amount of water or other polar substance. This water is absorbed or adsorbed into or onto the structure of the polymer, even after extensive drying. This is because such polymers are generally soluble or swellable in water and hence are quite hygroscopic. While the exact function of such absorbed water in the present invention is not clearly understood, it is believed that at least a trace of such material may be important for the polymer to adequately function in an ER fluid. It has been found that the performance of the ER fluids of the present invention is improved when a measurable amount of such a polar material is present. The amount and type of polar material will be selected by one skilled in the art based on the desired yield stress or shear stress desired, the current density acceptable, and the temperature range required for a particular application. Normally about 0.1 percent to about 30 percent by weight of a polar material will be contained in or on the polymer. Preferably the amount of such polar material is about 0.5 to about 20 percent by weight of the polymer, more preferably about 1 to about 10 percent by weight, and most preferably about 2.5 to about 7.5 percent by weight of the polymer. It is believed that this polar material is normally largely or completely associated with the polymer, although some portion may be found within the bulk of the ER fluid, dispersed or dissolved within the hydrophobic liquid phase. Accordingly, the amount of such polar material may alternatively be expressed as a fraction of the total ER fluid. Generally the fluid will contain about 0.03 to about 15 percent by weight of such polar material. Preferably the amount is about 0.16 to about 10 weight percent, more preferably about 0.3 to about 5 weight percent, and most preferably about 1 to about 3 weight percent.

The polar material is most commonly and most preferably water. However, other materials can be employed. They include such hydroxy-containing materials as alcohols and polyols, including ethylene glycol, glycerol, 1,3-propanediol, 1,4-butanediol, 1,5-pentanediol, 2,5-hexanediol, 2-ethoxyethanol, 2-(2-ethoxyethoxy)ethanol, 2-(2-butoxyethoxy)ethanol, 2-(2-methoxyethoxy)ethanol, 2-methoxyethanol, 2-(2-hexyloxyethoxy)ethanol, and glycerol monooleate, as well as amines such as ethanolamine and ethylenediamine. Other suitable materials are carboxylic acids such as formic acid and trichloroacetic acid. Also included are such aprotic polar materials as dimethylformamide, dimethylsulfoxide, propionitrile, nitroethane, ethylene carbonate, propylene carbonate, pentanedione, furfuraldehyde, sulfolane, diethyl phthalate, and the like.

It is believed that the polar material is normally in a liquid or fluid phase of some sort when in association with the polymer particles. It is believed that some degree of ionic motion occurs within this fluid polar material, which may be important to the functioning of the ER fluid. It is further believed that the hydrophilicity and the special structure of the polymers of the present invention lead to retention of sufficient water by the polymer to permit the present ER fluid to be useful even at elevated temperatures. However, the scope of the invention is not intended to be limited by any such theories or beliefs. While the polar material is normally physically adsorbed or absorbed by the polymer particles, it is also possible to chemically react at least a portion of the polar material with the polymer. This can be done, for example, by condensation of alcohol or amine functionality of certain polar materials with the acid or anhydride functionality of the polymer or its precursor. Such reaction products are illustrated in certain of the Examples which follow.

Dispersants are often desirable to aid in the dispersion of the polymer particles and to minimize or prevent their settling during periods of non-use. Such dispersants are known and can be designed to complement the properties of the hydrophobic fluid. For example, functionalized silicone dispersants or surfactants may be the most suitable for use in a silicone fluid, while hydroxyl-containing hydrocarbon-based dispersants or surfactants may be the most suitable for use in a hydrocarbon fluid. Functionalized silicone dispersants are described in detail in U.S. patent application Ser. No. 07/823,489, filed Jan. 21, 1992 and include e.g. hydroxypropyl silicones, aminopropyl silicones, mercaptopropyl silicones, and silicone quaternary acetates. Other dispersants include acidic dispersants, ethyoxylated nonylphenol, sorbitan monooleate, basic dispersants, sorbitan sesquioleate, ethoxylated coco amide, oleic acid, t-dodecyl mercaptan, modified polyester dispersants, ester, amide, or mixed ester-amide dispersants based on polyisobutenyl succinic anhydride, dispersants based on polyisobutyl phenol, ABA type block copolymer nonionic dispersants, acrylic graft copolymers, octylphenoxypolyethoxyethanol, nonylphenoxypolyethoxyethanol, alkyl aryl ethers, alkyl aryl polyethers, amine polyglycol condensates, modified polyethoxy adducts, modified terminated alkyl aryl ethers, modified polyethoxylated straight chain alcohols, terminated ethoxylates of linear primary alcohols, high molecular weight tertiary amines such as 1-hydroxyethyl-2-alkyl imidazolines, oxazolines, perfluoralkyl sulfonates, sorbitan fatty acid esters, polyethylene glycol esters, aliphatic and aromatic phosphate esters, alkyl and aryl sulfonic acids and salts, and tertiary amines.

As an alternative or supplement to the use of a dispersant, the acid-containing copolymer can be reacted with certain materials to provide derivatives which exhibit improved dispersability. Such derivatives can be prepared by starting with an anhydride-containing copolymer (e.g. one prepared using maleic anhydride) and reacting a few of the anhydride groups of the copolymer with a suitable polar reactant, by e.g. a condensation reaction. Thereafter the product is converted into a salt suitable for use in the present invention by neutralizing at least some of the remaining acid or anhydride groups. Suitable reactants include oleyl amine, Alfol TM 810 ($C_8$–$C_{10}$ alcohol), hydroxyl-, mercapto- or amine-functionalized silicone fluid, Carbowax TM (polyethyleneoxides or polyethyleneglycols), alkoxylated alkylamines (Jeffamines TM), aniline, and benzylamine.

The ER fluids of the present invention find use in clutches, valves, dampers, positioning equipment, and the like, where it is desirable to vary the viscosity of the fluid in response to an external signal. Such devices can be used, for example, to provide an automotive shock absorber which can be rapidly adjusted to meet the road conditions encountered during driving.

EXAMPLES

Examples 1–3 Synthesis of the Polymer

Example 1

A 5 L, 4-necked round bottom flask is charged with maleic anhydride (196 g, 2.0 moles) and 2764 g toluene solvent. The flask is fitted with a mechanical stirrer, a thermowell, a pressure-equalizing addition funnel, and a reflux condenser. The mixture is heated to 60° C.; after the maleic anhydride is dissolved, stirring is begun and the mixture is heated to 100° C. Styrene is added (208 g, 2.0 moles). The pressure of the mixture is reduced sufficiently to effect reflux of the toluene. A solution of benzoyl peroxide (0.86 g of 70 wt % benzoyl peroxide, 30% water) is prepared in 200 g of toluene and is added dropwise over 90 minutes. The reaction mixture is stirred for an additional 4 hours. The product copolymer is present as a slurry which is isolated by customary techniques.

Example 2

The procedure of Example 1 is substantially repeated, using 490 g maleic anhydride (5.0 moles) and 6900 g toluene. Styrene (572 mL, 5.0 moles) and methyl methacrylate (26.7 mL, 0.25 moles), are mixed together and added dropwise to the maleic anhydride solution; simultaneously the benzoyl peroxide (16.4 g of the 70% material, dissolved in 500 g toluene) is added dropwise. The temperature is maintained at 95° C. under slightly reduced pressure during the course of the reaction. The product is a slurry of a white, amorphous solid in toluene.

Example 3 Preparation of Branched/crosslinked Polymer

Example 3a

A 2 L resin flask is charged with 104 g styrene (1.0 mole), 98 g maleic anhydride (1.0 mole), 13 g divinylbenzene (0.1 mole), 32.4 g 0965.0 sorbitan monoleate (0.075 moles) emulsifier, and 200 g toluene. The flask is equipped with a mechanical stirrer, thermowell, dropping funnel, and water condenser. Over a period of 15 minutes 1.6 g (0.01 moles) of azobisisobutyronitrile initiator and 800 g water are added. The charge (an emulsion) is heated under nitrogen purge with stirring to 55°–60° C., which temperature is maintained for about 5 hours. An off-white solid is isolated by filtration, washing, drying at 100° C., and ball milling.

Example 3b

A 5 L resin flask is charged with 196 g (2.0 moles) maleic anhydride and 2800 g toluene. After heating under nitrogen to dissolve the maleic anhydride, 208 g styrene (2.0 moles) and 8 g divinylbenzene (0.06 mole) are added, while maintaining the temperature at 100° C. A solution of benzoyl peroxide (0.625 g, 0.0025 moles) in 125 g toluene is added over a period of 100 minutes. The heating and stirring are continued for another 4 hours. Filtering, washing, and drying provides the desired polymer.

Examples 4–9 Synthesis of Salts of Monovalent Metals

Example 4a.

To a 12 L flask is added 4025 g of a slurry of 25.1% an alternating 1:1 copolymer of maleic anhydride and styrene (5.0 moles of on anhydride groups), reduced specific viscosity of 0.42, in toluene (74.9%). An additional 3000 g toluene is added. A solution of sodium hydroxide (412 g, 10.0 moles) in 1500 g methanol is added with stirring over 1¼ hours at 23°–37° C. After the addition the mixture is stirred for six additional hours and allowed to stand overnight. The resulting white solid is isolated by filtration, washing with a toluene-methanol mixture, drying in a steam chest for four days, then under reduced pressure at 150° C. for 24 hours, ball milling, and further drying under reduced pressure at 150° C. for 16 hours. The resulting white powder is the sodium salt of the maleic anhydride/styrene polymer.

Example 4b

A 5 L flask is charged with 202 g (1.0 moles based on anhydride groups) of the styrene-maleic anhydride polymer used in Example 4a (but as a dry powder rather than a slurry) and with 82 g (2.0 moles) sodium hydroxide pellets. Distilled water, 2000 g, is added and the mixture is stirred overnight. The result is a clear, pale yellow solution. The water is evaporated and the product is dried in a vacuum oven at 130° C. for several days. After ball milling, the sodium salt is isolated as a white powder.

Example 5a

The procedure of Example 4a is substantially repeated except the styrene maleic anhydride polymer has a reduced specific viscosity of 0.69.

Example 5b

The procedure of Example 4a is substantially repeated except that the starting material is the copolymer of Example 2.

Example 6

The procedure of Example 4b is substantially repeated except that 1.0 moles of the polymer (based on anhydride groups) is reacted with 2.0 moles of lithium hydroxide monohydrate.

Example 7

The procedure of Example 6 is substantially repeated except that 2.0 moles of potassium hydroxide is used in place of the lithium hydroxide.

Example 8a

The procedure of Example 4a is substantially repeated except that 2.0 moles of the polymer (based on anhydride groups) is used and only 2.4 moles of NaOH is used.

Example 8b

The procedure of Example 4b is substantially repeated except that 1.0 moles of the polymer (based on anhydride groups) is used and only 1.6 moles of NaOH is used.

Example 8c

The procedure of Example 4b is substantially repeated except that 1.0 moles of the polymer (based on anhydride groups) is used and only 1.0 moles of NaOH is used. The reaction mixture is heated to 95° C. to assure complete reaction. The resulting polymer is isolated by conventional techniques.

Example 9

The procedure of Example 6 is substantially repeated except that 1.0 mole of the polymer (based on anhydride groups) is used and only 1.9 moles of the LiOH is used.

Example 10 Synthesis of Salts of Polyvalent Metals

The disodium salt (two sodium ions per reacted maleic anhydride group) of maleic acid/styrene copolymer (62.5 g, 0.23 moles based on anhydride group) is dissolved in 500 g water and added to a flask containing 300 g water and 28 g $CaCl_2$ (0.25 moles). After stirring for several hours the resulting calcium salt is separated by filtration, is washed, and dried. The procedure is substantially repeated with a variety of salts as shown in the following table:

| Experiment | Salt | moles salt/equiv. acid groups |
|---|---|---|
| a | $CaCl_2$ | 0.54 |
| b | $Al(NO_3)_3.H_2O$ | 0.33 |
| c | $FeCl_3$ | 0.34 |
| d | $CuSO_4.5H_2O$ | 0.48 |
| e | $Cr(NO_3).9H_2O$ | 0.34 |
| f | $MnCl_2$ | 0.50 |
| g | $MgCl_2$ | 0.50 |
| h | $ZnCl_2$ | 0.50 |
| i | $SnCl_2$ | 0.50 |
| j | $H_4Ce(S_4)_4$ | 0.50 |

Example 11 Preparation of Salts of Maleic Anhydride Styrene Copolymer Derivatives Example 11a A 1 L 4-neck flask is charged with 50.5 g dry powder maleic anhydride styrene 1:1 copolymer (0.25 moles based on anhydride) and 300 g acetone. Tributylamine (46.8 g, 0.25 moles) is added over a 30 minute period, at a temperature of 20–°27° C. The mixture is stirred overnight. The reaction mixture is dried in a steam chest for 9 days and in a vacuum oven at 125° C. for 24 hours. The resulting product is an off-white solid.

Example 11b

A slurry of 26.5% of the styrene/maleic anhydride copolymer in toluene (381 g of the slurry; 0.5 moles of anhydride), 250 g xylene, and 27.8 g (0.1 moles) oleylamine are mixed and heated for 3–4 hours at 123° C. with a nitrogen purge. After cooling to 35° C., 33 g NaOH (0.8 moles) dissolved in methanol is added over a period of ½ hour. The mixture is stirred for 3 days. A light yellow powder is isolated by filtration, washing, drying, and ball milling.

Example 11c

The procedure of Example 11b is substantially repeated except that the starting polymer is the terpolymer of Example 2.

Example 11d

The procedure of Example 11c is substantially repeated except that the amount of the oleylamine is 14 g (0.05 moles).

Example 11e

The procedure of Example 11c is substantially repeated except that the amount of the oleylamine is 7 g (0.025 moles).

Example 11f

The procedure of Example 11d is substantially repeated except that the copolymer is the 1:1 styrene maleic anhydride copolymer of Example 1.

Example 11 g

The procedure of Example 11f is substantially repeated except that the amount of the oleylamine is 7 g (0.025 moles).

Example 11h

The procedure of Example 11 is substantially repeated except that the amount of polymer is 102.5 g (0.5 moles of anhydride) and in place of the tributylamine is used benzylamine (10.8 g, 0.1 moles), which is initially charged into the flask along with the polymer and xylene solvent. The mixture is stirred overnight at 133°–138° C. The product is isolated by filtration and drying. A sample of this product (55.5 g, 0.25 moles), in toluene, is reacted with 16.4 g NaOH (0.40 moles) in 60 g methanol. After stirring for about 5 hours, the product is isolated by filtration, washing, and drying.

Example 11i

Maleic anhydride styrene copolymer (0.5 moles anhydride) is reacted with aniline (9.4 g, 0.1 moles) in toluene. The product is reacted with 0.8 moles NaOH in methanol, and the resulting salt is isolated by filtration.

Example 11j

Maleic anhydride styrene copolymer (0.5 moles anhydride) is reacted with 1,4-phenylenediamine (0.1 moles) in toluene. The product is reacted with 0.45 moles $LiOH.H_2O$ in water, and the resulting salt is isolated by filtration, washing, and drying.

Example 11k

A 1 L flask with condenser and nitrogen inlet is charged with 383 g of a 26.5% slurry of maleic anhydride styrene 1:1 copolymer in toluene (0.5 moles of anhydride), 500 g xylene, and 17.5 g (0.05 moles) Carbowax TM 350 (from Union Carbide). The mixture is heated to 125° C. and is stirred overnight. The mixture is cooled to 27° C. and a solution of 37 g NaOH (0.9 moles) in 150 g methanol is added. After stirring for an additional 7 hours, the product is isolated by filtration, washing, and drying.

Example 11l

Example 11k is substantially repeated except that the amount of Carobwax TM 350 is 35 g (0.1 moles).

Example 11m

A 1 L flask as in Example 11k, further provided with a Dean-Stark trap, is charged with styrene maleic anhydride polymer, 101 g (0.5 moles as anhydride) and 500 g toluene. To this mixture is added over a period of 20 minutes 21.25 g Jeffamine TM D400 (0.05 moles, $H_2NCHCH_3CH_2(OCH_2CHCH_3)_5NH_2$). The mixture is stirred at 100° C. for 4 hours 1 mL of water is collected in the trap. After cooling, the product is isolated by filtration, washing, and drying.

Example 11n

Styrene maleic anhydride copolymer (1.0 moles anhydride) is reacted with ethylene glycol (1.0 moles) in toluene at 70° C. The resulting solid is isolated or alternatively is further reacted, without isolation, with NaOH (1.0 moles) in methanol. The product is isolated by filtration, washing, and drying.

Example 11o

Styrene maleic anhydride copolymer (1.0 moles anhydride) is mixed in toluene with glycerol monooleate (95,8% mono, 1.0 moles) at 62°–102° C. Methane-sulfonic acid (1.2 g) is added to induce reaction. The reaction product is isolated by filtration, washing, and drying. A portion of the product (157 g, 0.5 moles) is reacted with $LiOH.H_2O$ (21 g, 0.5 moles) in water and the resulting salt is isolated by filtration.

Example 11p

Styrene maleic anhydride copolymer (202 g, 1.0 moles anhydride) is reacted with ethanolamine (62 g, 1.0 moles) in toluene, with heating and stirring. The product is reacted with 41 g NaOH (1.0 moles) in methanol. The resulting polymeric salt is isolated by filtration, washing, and drying.

Example 11q

A 2 L flask is charged with styrene maleic anhydride copolymer (382 g, 0.5 moles anhydride), xylene (500 g), functionalized silicone fluid (Genesee TM EXP-69, 32.5 g, 0.0043 moles, approximate formula $(CH_3)_3SiO—[Si(CH_3)_2O]_{96}—[Si(CH_3)(C_3H_6OH)O]_6—Si(CH_3)_3$), and 0.3 g methanesulfonic acid. The mixture is stirred for 5 hours while heated under nitrogen to 127° C. The mixture is cooled to room temperature and allowed to stand for three days. Sodium hydroxide (37 g, 0.9 moles) in methanol (150 g) is added at room temperature and stirred for 8 hours, then allowed to stand overnight. The product is isolated by filtration, washing, and drying.

Example 11r

The procedure of Example 11q is substantially repeated except that the functionalized silicone fluid is Genesee TM GP-4 (30 g, 0.0062 moles, approximate formula $(CH_3)_3SiO—[Si(CH_3)_2O]_{58}—[Si(CH_3)(C_3H_6NH_2)O]_4—Si(CH_3)_3$), no methanesulfonic acid is employed, and the reaction temperature for the first portion of the procedure is 130°–137° C.

Example 11s

The procedure of Example 11q is substantially repeated except that the functionalized silicone fluid is replaced with 14.4 g Alfol TM 810 (0.1 moles).

Example 12 Reaction of Maleic Anhydride Styrene Copolymer with Complexing Agents and Copper Salts Example 12a Styrene maleic anhydride copolymer (1.0 moles anhydride) is reacted with ethylenediamine (61 g, 1.0 moles) in toluene, at room temperature with stirring. After about 1 day, the product is isolated by filtration, washing, and drying. One hundred grams of the product (0.31 moles) in 500 g methanol is reacted with 54 g $CuCl_2.2H_2O$ (0.31 moles) in 200 g methanol, with stirring. The resulting salt is isolated by filtration, washing, and drying.

Example 12b

Styrene maleic anhydride copolymer in a toluene slurry (756 g, 26.7% polymer, 1.0 moles anhydride) is reacted with 4-aminosalicylic acid (77.5 g, 0.5 moles) in 1200 g xylene. During heating and stirring at 126° C. for about 4 hours, 0.5 mL water is collected in a Dean-Stark trap. After cooling the mixture to 75° C., 500 g acetone is added and stirring continued for another hour. The reaction product is isolated by filtration and drying.

Example 12c

The procedure of Example 12b is substantially repeated using however 155 g (1.0 moles) 4-aminosalicylic acid and collecting 9 mL of water in the Dean-Stark trap.

Example 12d

The product of Example 12c (85.5 g, 0.5 moles) is mixed with 800 g water and 20.5 g NaOH (0.5 moles) with stirring for several hours. A solution of $CuCl_2.2H_2O$ (43 g, 0.25 moles) in 200 g water is added and the mixture stirred for an additional 90 minutes. The product is isolated by filtration, washing with water, and drying.

Example 12e

Example 12d is substantially repeated except that no copper salt is added. The product is isolated by drying.

Example 13 Preparation of Miscellaneous Polymeric Salts

Example 13a

To the sodium neutralized polymer of Example 4a (1900 g, 0.59 moles) is added 377 g poly-acrylic acid (0.32 moles functionality) in solution, with stirring. The product mixture is dried to provide the final product.

Example 13b

Example 13a is repeated using 0.5 moles of the sodium neutralized polymer of Example 4a and 137.5 g of a 30% aqueous solution of polystyrene sulfonic acid (0.25 moles functionality).

Examples 14–77 Preparation of ER Fluids

The polymeric salts from the previous Examples are used to prepare electrorheologically active fluids. The compositions of the fluids are as shown in the table below. In this table, the hydrophobic liquid phase is indicated as follows:

| BASE FLUIDS | |
|---|---|
| A | sunflower oil |
| B | rapeseed oil |
| C | soybean oil |
| D | di-isodecyl azelate |
| E | hydrogenated poly-α-olefin |
| F | silicone oil, 10 cst |

The polar materials are indicated as follows:

| POLAR MATERIALS | |
|---|---|
| K | Ethylene glycol |
| L | Glycerol |
| M | 1,3-Propanediol |
| N | 1,4-Butanediol |
| O | 1,5-Pentanediol |
| P | 2,5-Hexanediol |
| Q | 2-Ethoxyethanol |
| R | 2-(2-Ethoxyethoxy)ethanol |
| S | 2-(2-Butoxyethoxy)ethanol |
| T | 2-(2-Methoxyethoxy)ethanol |
| U | 2-Methoxyethanol |
| V | 2-(2-Hexyloxyethoxy)ethanol |
| W | Water |

The dispersants are as indicated as follows:

| DISPERSANTS | |
|---|---|
| aa | Hydroxypropyl polysiloxane |
| bb | Mercaptopropyl polysiloxane |
| cc | Carboxypropyl polysiloxane |
| dd | Aminopropyl polysiloxane |
| ee | ethoxylated polysiloxane |
| ff | Glycerol monooleate |
| gg | Bis(2-hydroxyethyl)tallowamine |
| hh | Alkenyl succinic ester (pentaerythritol ester) |
| ii | Alkenyl succinimide |
| jj | $C_{12}$ alkyl phenol |
| kk | Hypermer TM KD-3 polymeric dispersant (from ICI) |
| ll | Solsperse TM hyperdispersant (from ICI) |

TABLE OF ER FLUID COMPOSITIONS

| | Particles | | Base | Polar Mat'l | | Dispersant | |
|---|---|---|---|---|---|---|---|
| Ex. | type[a] | % | fluid | type | %[b] | type | % |
| 14 | 4a | 5 | A | W | 2.2 | — | 0 |
| 15 | 4a | 30 | B | W | 2.2 | — | 0 |
| 16 | 4a | 35 | C | W | 2.2 | — | 0 |
| 17 | 4a | 40 | D | W | 2.2 | — | 0 |
| 18 | 4a | 45 | E | W | 2.2 | — | 0 |
| 19 | 4a | 60 | F | W | 2.2 | — | 0 |
| 20 | 4a | 40 | F | W | 0.03 | — | 0 |
| 21 | 4a | 40 | F | W | 0.9 | — | 0 |
| 22 | 4a | 40 | F | W | 1.25 | — | 0 |
| 23 | 4a | 40 | F | W | 1.75 | — | 0 |
| 24 | 4a | 40 | F | W | 2.25 | — | 0 |
| 25 | 4a | 40 | F | W | 2.70 | — | 0 |
| 26 | 4a | 40 | F | W | 5.0 | — | 0 |
| 27 | 4a | 30 | F | W | 15 | — | 0 |
| 28 | 4a | 40 | F | K | 2 | — | 0 |

-continued

TABLE OF ER FLUID COMPOSITIONS

| Ex. | Particles type[a] | Particles % | Base fluid | Polar Mat'l type | Polar Mat'l %[b] | Dispersant type | Dispersant % |
|---|---|---|---|---|---|---|---|
| 29 | 4a | 40 | F | L | 2 | — | 0 |
| 30 | 4a | 40 | F | M | 2 | — | 0 |
| 31 | 4a | 40 | F | N | 2 | — | 0 |
| 32 | 4a | 40 | F | O | 2 | — | 0 |
| 33 | 4a | 40 | F | P | 2 | — | 0 |
| 34 | 4a | 40 | F | Q | 2 | — | 0 |
| 35 | 4a | 40 | F | R | 2 | — | 0 |
| 36 | 4a | 40 | F | S | 2 | — | 0 |
| 37 | 4a | 40 | F | T | 2 | — | 0 |
| 38 | 4a | 40 | F | U | 2 | — | 0 |
| 39 | 4a | 40 | F | V | 2 | — | 0 |
| 40 | 5a | 40 | A | W | 2.2 | — | 0 |
| 41 | 6 | 40 | A | W | 2.2 | — | 0 |
| 42 | 7 | 40 | A | W | 2.2 | — | 0 |
| 43 | 8c | 40 | A | W | 2.2 | — | 0 |
| 44 | 10a | 40 | A | W | 2.2 | — | 0 |
| 45 | 10b | 40 | A | W | 2.2 | — | 0 |
| 46 | 10c | 40 | A | W | 2.2 | — | 0 |
| 47 | 10d | 40 | A | W | 2.2 | — | 0 |
| 48 | 10e | 40 | A | W | 2.2 | — | 0 |
| 49 | 10f | 40 | A | W | 2.2 | — | 0 |
| 50 | 10g | 40 | A | W | 2.2 | — | 0 |
| 51 | 10h | 40 | F | W | 2.2 | — | 0 |
| 52 | 10i | 40 | F | W | 2.2 | — | 0 |
| 53 | 10j | 40 | F | W | 2.2 | — | 0 |
| 54 | 11b | 40 | F | W | 2.2 | — | 0 |
| 55 | 11h | 40 | F | W | 2.2 | — | 0 |
| 56 | 11i | 40 | F | W | 2.2 | — | 0 |
| 57 | 11j | 40 | F | W | 2.2 | — | 0 |
| 58 | 11k | 40 | F | W | 2.2 | — | 0 |
| 59 | 11m | 40 | F | W | 2.2 | — | 0 |
| 60 | 11n | 40 | F | W | 2.2 | — | 0 |
| 61 | 11q | 40 | F | W | 2.2 | — | 0 |
| 62 | 11r | 40 | F | W | 2.2 | — | 0 |
| 63 | 11s | 40 | F | W | 2.2 | — | 0 |
| 64 | 12c | 40 | F | W | 2.2 | — | 0 |
| 65 | 13a | 40 | F | W | 2.2 | — | 0 |
| 66 | 4a | 40 | F | W | 2 | aa | 1 |
| 67 | 4a | 40 | F | W | 2 | bb | 3 |
| 68 | 4a | 40 | F | W | 2 | cc | 3 |
| 69 | 4a | 40 | F | W | 2 | dd | 3 |
| 70 | 4a | 40 | F | W | 2 | ee | 3 |
| 71 | 4a | 40 | A | W | 2 | ff | 3 |
| 72 | 4a | 40 | B | W | 2 | gg | 3 |
| 73 | 4a | 40 | C | W | 2 | hh | 3 |
| 74 | 4a | 40 | D | W | 2 | ii | 3 |
| 75 | 4a | 40 | D | W | 2 | jj | 3 |
| 76 | 4a | 40 | E | W | 2 | kk | 3 |
| 77 | 4A | 40 | E | W | 2 | 11 | 5 |

[a]Refers to the polymer of the Example indicated.
[b]% based on the total composition.

Example 78 Testing of the ER Fluids

The compositions of Examples 14–77 are tested for shear stress, yield stress, and current density with no applied field and in the presence of up to a 6 kV/mm applied field, using oscillating duct flow testing or Couette testing. In the oscillating duct flow testing data is gathered using an oscillating test fixture which pumps the ER fluid back and forth through parallel plate electrodes. The shear stress is determined by measuring the force required to move the fluid through the electrodes. The mechanical amplitude is ±1 mm and the electrode gap is 1 mm. The mechanical frequency range is 0.5 to 30 Hz which produces a shear rate range of 600 to 36,000 $s^{-1}$. The shear rate is calculated at the wall of the electrodes assuming Poiseuille flow. The apparatus is capable of testing a fluid over the temperature range of −20° to 120° C. Three tests are performed at each temperature in this test:

Test 1

The fixture is oscillated at a fixed frequency and stroke, while a DC electric field across the is steadily increased. The data is reported as shear stress (kPa) versus electric field (kV/mm).

Test 2

The fixture is oscillated over a frequency range from 0.5 to 30 Hz while a fixed DC electric field is applied to the ER fluid. The data is reported as (a) shear stress (kPa) versus shear rate ($s^{-1}$) for four values of electric field, and (b) current density ($mA/m^2$) versus shear rate for the same four electric fields.

Test 3

The fixture is oscillated at a fixed frequency and stroke, wile a DC electric field is pulsed on and off. The data is reported as both shear stress (kPa) and electric field (kV/mm) versus time in seconds. This test gives a first approximation of the response time behavior of an ER fluid in the duct flow geometry.

In the Couette testing, data is gathered using a custom horizontal concentric cylinder electrorheometer. The shear stress is determined by measuring the torque required to rotate an inner cylinder separated from an outer cylinder by the ER fluid. Because this rheometer uses a lip seal, some seal drag is apparent in the measurements. The shear rate is determined from the rotation rate assuming couette flow. This device has a shear rate range of 20 to 1000 $s^{-1}$. The electrode gap is 1.25 mm. This rheometer can evaluate fluids over the temperature range of −20° to 120° C. Three tests are performed at each temperature in this test:

Test 4

The inner cylinder is rotated at a fixed rate while a DC electric field across the fluid is steadily increased. The data is reported as shear stress (kPa) versus electric field (kV/mm).

Test 5

The inner cylinder's rotation rate is varied to produce a shear rate sweep from 20 to 1000 $s^{-1}$ while a fixed DC electric field is applied to the ER fluid. The data is reported as (a) shear stress (kPa) versus shear rate ($s^{-1}$) for four values of electric field, and (b) current density ($mA/m^2$) versus shear rate for the same four electric fields.

Test 6

The inner cylinder is rotated at a fixed rate while a DC electric field is pulsed on and off. The data is reported as both shear stress (kPa) and electric field (kV/mm) versus time in seconds. This test gives a first approximation of the response time behavior of an ER fluid in the Couette flow geometry.

Each sample is evaluated in terms of the dimensionless Winslow number, Wn, where $$Wn = \frac{(YS)^2}{(PD)(\eta_o)}$$

$YS$ = Yield Stress $PD$ = Power Density ($w/m^3$)

= current density × field strength $\eta_o$ = viscosity with no field applied ($PaS$)

Each sample exhibits electrorheological properties. It is observed that the best water-containing samples have a water content of about 2.25 weight percent. The samples prepared from the salts of sodium, potassium, lithium, calcium and aluminum give better results than the other samples. Several of the Li, Na, and K salts (Examples 24, 41, and 42) are examined for electrorheological properties as a function of temperature. These samples exhibit good ER behavior at temperatures at least as high as 120° C.

Example 79

Copolymers of maleic anhydride and styrene in mole ratios 1:1, 1:2, and 1:3 are converted to their fully neutralized lithium salts. Blends containing 40% of the polymeric salt and a matrix fluid, along with 0.9 to 2.0% water, are evaluated and found to exhibit ER activity.

Each of the documents referred to above is incorporated herein by reference. As used herein, the expression "consisting essentially of" permits the inclusion of small amounts of substances which do not materially affect the basic and novel characteristics of the composition under consideration.

What is claimed is:

1. A method for increasing the apparent viscosity of a fluid comprising (a) a hydrophobic liquid phase which comprises a liquid which is stable up to about 120° C., and (b) particles of a polymer dispersed therein, said polymer comprising an alkenyl substituted aromatic comonomer, a maleic acid comonomer or derivative thereof, and 0 to about 20 mole percent of at least one third comonomer, wherein the polymer contains acid functionality which is at least partly in the form of a salt;

said method comprising subjecting the fluid to an electric field.

2. The method of claim 1 wherein the maleic acid comonomer or derivative thereof is a salt of a partial ester of maleic acid comonomer.

3. The method of claim 1 wherein the maleic acid comonomer or derivative thereof is at least partially neutralized with a metal cation selected from the group consisting of sodium, potassium, lithium, calcium, and aluminum.

4. The method of claim 1 wherein the alkenyl substituted aromatic comonomer is styrene or substituted styrene.

5. The method of claim 1 wherein the polymer comprises 0 to about 5 mole percent of a third comonomer selected from the group consisting of ethylenically unsaturated carboxylic acids having 3 to about 22 carbon atoms, salts, esters, and amides of said acids, vinyl ethers having 3 to about 22 carbon atoms, vinyl esters of carboxylic acids where the acid group has 1 to about 22 carbon atoms, and alpha olefins of 2 to about 20 carbon atoms.

6. The method of claim 1 wherein the polymer is substantially free from third comonomer.

7. The method of claim 6 wherein the mole ratio of alkenyl substituted aromatic comonomer to maleic acid or derivative is about 1:1.

8. The method of claim 1 wherein the fluid further comprises about 0.03 to about 15 percent by weight polar material selected from the group consisting of water, alcohols, polyols, amines and carboxylic acids.

9. The method of claim 1 wherein the amount of the polymer particles in the fluid is about 5 to about 60 percent by weight of the fluid.

10. The method of claim 1 wherein the fluid further contains a dispersing agent in an amount sufficient to improve the dispersion of the polymer particles.

11. The method of claim 10 wherein a portion of the acid functionality of the maleic acid comonomer is reacted with the dispersing agent.

12. The method of claim 11 wherein the mole ratio of alkenyl substituted aromatic comonomer to maleic acid or derivative is about 5:1 to about 1:1.5.

* * * * *